US005254903A

United States Patent [19]

Jo et al.

[11] Patent Number: 5,254,903

[45] Date of Patent: Oct. 19, 1993

[54] CATHODE RAY TUBE

[75] Inventors: Cheol-sik Jo, Seoul; Seong-wu Ham, Kyunggi-do, both of Rep. of Korea

[73] Assignee: Samsung Electron Devices, Co., Ltd., Kyunggi-do, Rep. of Korea

[21] Appl. No.: 815,038

[22] Filed: Dec. 31, 1991

[30] Foreign Application Priority Data

Jul. 10, 1991 [KR] Rep. of Korea ..... 91-10560

[51] Int. Cl.[5] ..... H01J 29/48

[52] U.S. Cl. ..... 313/450; 313/414

[58] Field of Search ..... 313/414, 432, 450, 479

[56] References Cited

U.S. PATENT DOCUMENTS 2,726,348 12/1955 Benway .
3,327,160 6/1967 Schlesinger ..... 313/432 X
4,961,022 10/1990 Hellings et al. ..... 313/450 X
4,980,606 12/1990 Yamauchi et al. ..... 313/450 X

FOREIGN PATENT DOCUMENTS 2246057 4/1974 France ..... 313/450

*Primary Examiner*—Sandra L. O'Shea
*Attorney, Agent, or Firm*—Leydig, Voit & Mayer

[57] ABSTRACT

A cathode ray tube includes a plurality of electrode layers which are separately formed in the advancing direction of electron beam, and form a plurality of electrostatic lenses along with corresponding electrodes of an electron gun upon applying voltages of differing potentials. The cathode ray tube has an accelerating electrode layer as an accelerating electrode which forms a main lens with a focusing electrode of the electron gun, and an electrode layer as a prefocusing electrode which forms a prefocusing lens with the focusing electrode and other electrodes, so that the electron beam is accelerated and focused by the electrode layer formed on the inner surface of a neck. The image quality realized on the screen can be improved, while reducing the length of the neck.

1 Claim, 2 Drawing Sheets

CATHODE RAY TUBE

BACKGROUND OF THE INVENTION

The present invention relates to a cathode ray tube, and particularly to a cathode ray tube wherein a plurality of electrode layers forming a main lens along with electrodes of the electron gun are provided on the inner wall of the neck.

Generally, a cathode ray tube is constructed such that a phosphor layer constituting a screen is formed on the inside flat bottom of an envelope, an electron gun is inserted into the neck opposing the flat bottom of the envelope, a conductive layer is formed on the inner surface of the envelope's conical portion between the neck and the screen, and a deflection yoke is installed around the neck adjacent to the exiting region of the electron beam being emitted from the electron gun. While the funnel and panel of the envelope are coupled in color cathode ray tubes, the funnel and panel of most monochrome cathode ray tubes are united as one body without being separated.

The electron gun of such a conventional cathode ray tube comprises a triode consisting of a cathode, a control electrode, and a screen electrode, and a main lens consisting of a focusing electrode and an anode. To weaken the influence of spherical aberration and astigmatism on the electron beam emitted from the electron gun, the main lens is composed of at least three electrodes, thereby controlling the electron beam by multiple steps. By this operation, however, the electron gun is considerably lengthened, which in turn lengthens the neck housing the electron gun, i.e., the total length of cathode ray tube.

In order to minimize the influence of the electron lenses' spherical aberration of the electron beam, the diameter of the lenses' apertures must be enlarged. In an effort to solve the problem, a technique has been suggested in U.S. Pat. No. 2,726,348 as illustrated in FIG. 1. Here, an accelerating electrode layer 15 is electrically connected to an inner graphite layer **1*b* on the conical portion, and serves as the last accelerating electrode which is provided on the inner surface of neck 1*a* adjacent to the electron beam emitting region of electron gun 1' of cathode ray tube 1. Here, accelerating electrode layer 15 functions as the last accelerating electrode, and surrounds only a portion of the end of focusing electrode 14 which is the last electrode, and not cathode 11, control electrode 12, or screen electrode 13**.

In this conventional cathode ray tube, the spherical aberration can be improved. However, it is disadvantageous in that the neck of the cathode ray tube must be considerably lengthened to improve the focusing characteristic of electron beam.

SUMMARY OF THE INVENTION

Accordingly, it is an object of the present invention to provide a cathode ray tube wherein the neck is shortened, and the image quality reproduced on the screen is improved.

To achieve these and other objects, the cathode ray tube according to the present invention comprises a conductive layer on the inner surface of the conical body opposing a flat bottom of an envelope, a phosphor layer constituting a screen on the flat bottom, an electron gun which is provided in the neck extending from the conical body to face the flat bottom for emitting an electron beam to the screen, and electrode layer means which are provided on the inner surface of the neck and form electrostatic lenses for controlling the electron beam along with the electron gun's electrodes, wherein the electrode layer means comprises a plurality of separate electrode sequentially disposed in the advancing direction of the electron beam, and the electrode layer means form a plurality of electrostatic lenses along with corresponding electrodes of the electron gun upon applying voltages of differing potentials.

Preferably, in the cathode ray tube of the present invention, the conductive layer on the inner surface of conical body is directly and electrically connected to the last electrode layer among the plurality of separate electrode layers adjacent to the conductive layer, and other electrode layers adjacent to the last electrode layer are electrically connected to one another through a resistance layer, so that voltage of different potential are provided to respective electrode layers.

On the other hand, in the cathode ray tube having the aforesaid structure, at least any one between an accelerating electrode layer surrounding the end of the focusing electrode positioned at the last portion of electron gun, and the focusing electrode layer positioned between the focusing electrode and other preceding electrodes.

BRIEF DESCRIPTION OF THE DRAWINGS

These and other objects, features, aspects and advantages of the present invention will become more apparent from the following detailed description of the present invention when taken in conjunction with the accompanying drawings, in which.

DESCRIPTION OF THE INVENTION

Figure 1:
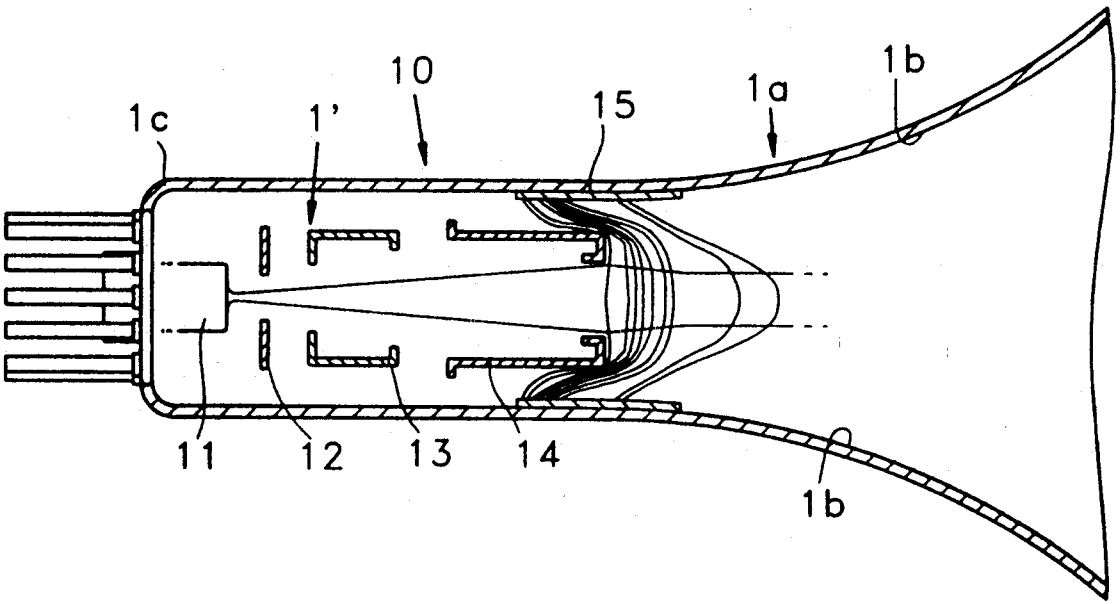
FIG. 1 (PRIOR ART)
FIG. 1 is a partially extracted sectional view showing a neck of a conventional cathode ray tube having an accelerating electrode layer as the last accelerating electrode of electron beam.
Figure 2:
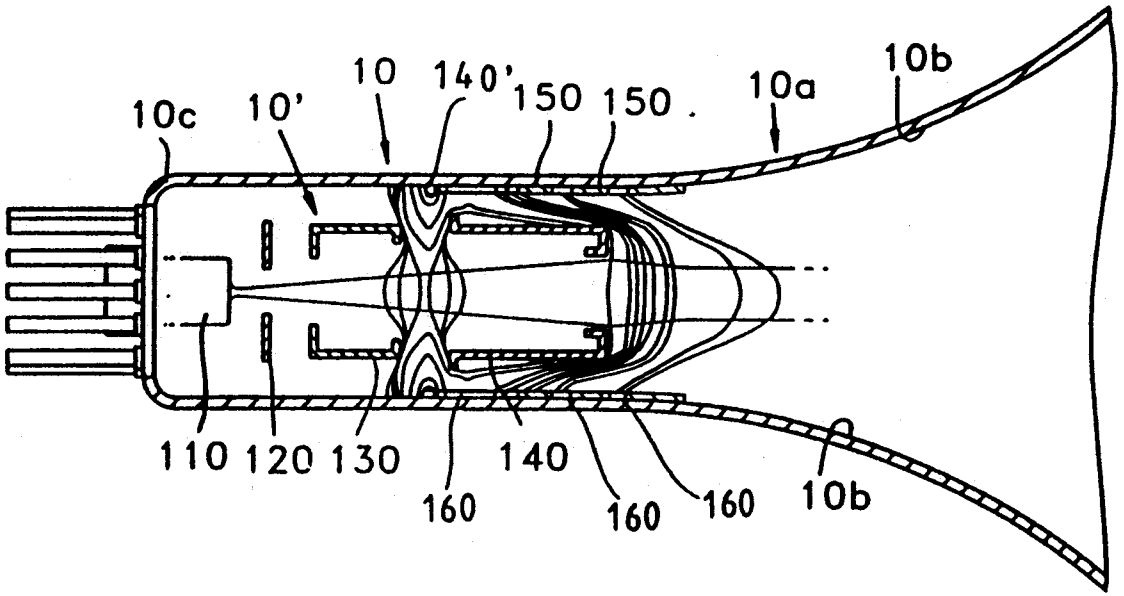
FIG. 2 is a partially extracted sectional view showing a neck of a cathode ray tube according to the present invention.

As illustrated in FIG. 2, a cathode ray tube 10 according to the present invention comprises a neck **10*c* in which an electron gun 10' is inserted into the rear portion of an envelope 10*a* having a graphite coating 10*b* thereon. Electron gun 10' includes a triode consisting of a cathode 110, a control electrode 120, and a screen electrode 130, and a main lens including a focusing electrode 140. Also, at least one accelerating electrode layer 150 forming the main lens along with focusing electrode 140 is formed on the inner surface of neck 10*c*. A focusing electrode layer 140' constituting an auxiliary lens along with screen electrode 130 and focusing electrode 140 is formed on the inner surface of neck 10*c* between screen electrode 130 and focusing electrode 140**.

Here, focusing electrode layer 140' is placed on the inner surface of neck **10*c* between screen electrode 130 and focusing electrode 140, and the focusing electrode layer 140' is separated from accelerating electrode layer 150 by a predetermined distance. Accelerating electrode layer 150 is electrically connected to graphite conductive layer 10*b* coated on the inner surface of the envelope, and a resistance material 160 is coated between accelerating electrode layer 150 and an inner graphite layer forming focusing electrode layer 140', so that the potential applied to focusing electrode layer 140′ from accelerating electrode layer 150** descends in sequence by steps.

The operation of the above-described cathode ray tube is stated below.

By applying voltage to each electrode of electron gun 10′ of the present invention, a prefocus electrostatic lens of main lens is formed between screen electrode 130 and focusing electrode 140, and a main focus electrostatic lens of main lens is formed between focusing electrode 140 and accelerating electrode layer 150. The prefocus lens is composed of a virtual plurality of lenses by focusing electrode layer 140′ which is interposed between screen electrode 130 and focusing electrode 140.

Accordingly, the cathode ray tube of the present invention has a characteristic that the prefocus electrostatic lens and a major electrostatic lens are combined by the focusing electrode layer and accelerating electrode layer. Thus, the spherical aberration can be improved by a multi-step focusing effect of the electron beam and enlarging the lens diameter. Further, the cathode ray tube structurally has a multi-step main lens, so that the neck is shorter than that of a conventional electron gun. Especially, according to the experiments of this applicant, when the inner graphite layer coated on the inner surface of the neck is adopted as the electron gun's electrode, the overall length of cathode ray tube was decreased by 20%, and the focusing characteristic was improved by 25% or more.

As described above, the cathode ray tube according to the present invention can be adopted to all kinds of cathode ray tubes such as a color cathode ray tube, a monochrome cathode ray tube for TV or computer monitor, a cathode ray tube for projector, etc. Cathode ray tubes adopting the present invention are characterized by superior image quality, and decreased neck lengths.

What is claimed is:

1. A cathode ray tube, comprising:

a conductive layer on an inner surface of a conical body;

an electron gun having a control electrode, a focusing electrode and a screen electrode, said electron gun being provided in a neck which extends from the conical body to face the flat bottom for emitting an electron beam to the screen;

a plurality of electrode layers which are sequentially provided on the inner surface of the neck and form electrostatic lenses for controlling an electron beam along with the electrodes of said electron gun; and a plurality of resistance layers, each resistance layer being disposed adjacent electrode layers on the inner surface of the neck;

wherein said conductive layer is electrically connected to the last electrode layer of said plurality of electrode layers and said plurality of electrode layers comprise an accelerating electrode layer surrounding the end of the focus electrode and a focusing electrode layer positioned between the focusing electrode and the screen electrode.

* * * * *